US005977237A

United States Patent [19]

Shin et al.

[11] Patent Number: 5,977,237

[45] Date of Patent: Nov. 2, 1999

[54] FLASH-SPINNING SOLUTION

[75] Inventors: Hyunkook Shin, Wilmington; Roger Keith Siemionko, Hockessin, both of Del.

[73] Assignee: E. I. du Pont de Nemours and Company, Wilmington, Del.

[21] Appl. No.: 08/918,780

[22] Filed: Aug. 25, 1997

Related U.S. Application Data

[63] Continuation-in-part of application No. 08/902,645, Jul. 30, 1997, Pat. No. 5,874,036, which is a continuation-in-part of application No. 08/612,714, Mar. 8, 1996, Pat. No. 5,672,307.

[51] Int. Cl.[6] ..... C08K 5/02

[52] U.S. Cl. ..... 524/463; 524/465; 524/466; 528/490; 528/491; 264/172.16

[58] Field of Search ..... 524/463, 465, 524/466; 528/490, 491; 264/172.16

[56] References Cited

U.S. PATENT DOCUMENTS

| | | | |
|---|---|---|---|
| 3,081,519 | 3/1963 | Blades et al. | 28/81 |
| 3,227,664 | 1/1966 | Blades et al. | 260/2.5 |
| 3,637,458 | 1/1972 | Parrish | 161/160 |
| 3,851,023 | 11/1974 | Brethauer et al. | 264/24 |
| 5,023,025 | 6/1991 | Shin | 264/13 |
| 5,032,326 | 7/1991 | Shin | 264/13 |
| 5,081,177 | 1/1992 | Shin | 524/463 |
| 5,147,586 | 9/1992 | Shin et al. | 264/13 |
| 5,206,441 | 4/1993 | Reimer | 568/342 |
| 5,250,237 | 10/1993 | Shin | 264/13 |
| 5,286,422 | 2/1994 | Kato et al. | 264/13 |
| 5,369,165 | 11/1994 | Kato et al. | 524/462 |

FOREIGN PATENT DOCUMENTS

| | | |
|---|---|---|
| 0 357 381 | 3/1990 | European Pat. Off. . |
| 0 361 684 | 4/1990 | European Pat. Off. . |
| 0 407 953 | 1/1991 | European Pat. Off. . |
| 0 442 346 | 8/1991 | European Pat. Off. . |
| 0 527 019 | 7/1992 | European Pat. Off. . |
| 5-263310 | 10/1993 | Japan . |
| 6-101113 | 4/1994 | Japan . |
| WO 94/23091 | 10/1994 | WIPO . |
| WO 94/23097 | 10/1994 | WIPO . |

*Primary Examiner*—Tae Yoon

[57] ABSTRACT

A flash-spinning solution of a polyolefin dissolved in a primary solvent selected from the group consisting of methylene chloride and dichloroethylene, and a co-solvent selected from the group of hydrofluoroethers, cyclic perfluorinated hydrocarbons, and cyclic partially fluorinated hydrocarbons.

7 Claims, 15 Drawing Sheets

FLASH-SPINNING SOLUTION

This application is a continuation-in-part of application Ser. No. 08/902,645, filed on Jul. 30, 1997, now U.S. Pat. No. 5,874,836 entitled "Flash-Spinning Process and Flash-Spinning Solution" which is a continuation-in-part of application Ser. No. 08/612,714, filed Mar. 8, 1996, now U.S. Pat. No. 5,672,307.

FIELD OF THE INVENTION

This invention relates to flash-spinning of polymeric plexifilamentary film-fibril strands. More particularly, this invention relates to a spin fluid that may be used in existing commercial flash-spinning equipment with minimum changes in the equipment. When used in flash-spinning, the spin fluid does not release to the atmosphere ozone depletion components, and the spin solution results in a spinning atmosphere of low flammability.

BACKGROUND OF THE INVENTION

Commercial spunbonded products made from polyethylene plexifilamentary film-fibril strands have been produced by flash-spinning from trichlorofluoromethane; however, trichlorofluoromethane is an atmospheric ozone depletion chemical, and therefore, alternatives have been under investigation. Shin U.S. Pat. No. 5,032,326 discloses one alternative spin fluid, namely, methylene chloride and a co-solvent halocarbon having a boiling point between minus 50° C. and 0° C. As pointed out in Kato et al. U.S. Pat. No. 5,286,422, the Shin methylene chloride based process is not entirely satisfactory, and the '422 patent discloses an alternative, namely, a spin fluid of bromochloromethane or 1,2-dichloroethylene and a co-solvent, e.g., carbon dioxide, dodecafluoropentane, etc.

Published Japanese Application JO5263310-A (published Oct. 12, 1993) discloses that three-dimensional fiber favorable for manufacturing flash-spun non-woven sheet may be made from polymer dissolved in mixtures of solvents where the major component of the solvent mixture is selected from the group consisting of methylene chloride, dichloroethylene, and bromochloromethane, and the minor component of the solvent mixture is selected from the group consisting of dodecafluoropentane, decafluoropentane, and tetradecafluorohexane.

SUMMARY OF THE INVENTION

The present invention is a spin fluid useful in a process for the preparation of plexifilamentary film-fibril strands of synthetic fiber-forming polyolefin by flash-spinning the spin fluid at a pressure that is greater than the autogenous pressure of the spin fluid into a region of lower pressure. The spin fluid consists essentially of (a) 5 to 30 wt. % synthetic fiber-forming polyolefin, (b) a primary solvent selected from the group consisting of methylene chloride and 1,2-dichloroethylene, and (c) a co-solvent selected from the group consisting of cyclic partially fluorinated hydrocarbons, hydrofluoroethers, and cyclic perfluorinated hydrocarbons, said co-solvent having (i) 3 to 7 carbon atoms and (ii) an atmospheric boiling point between 15 and 100° C., said co-solvent being present in the spin fluid in an amount sufficient to raise the cloud point pressure of the spin fluid by at least 50 pounds per square inch.

Suitable co-solvents may be selected from the group consisting of 1-trifuoromethyl-1-fluoro-2,2-difluorocyclobutane; 1,1,2,2,3,3-hexafluorocyclopentane; 1,1,2,2,3,3,4,5-octafluorocyclopentane; 1,1,1,2,3,3-fluoropropyl methyl ether; 1,1,1,2,2,3,3-fluoropropyl 1,2,2,2-fluoroethyl ether, i.e., $CF_3CF_2CF_2$—O—$CHFCF_3$; 1,1,1,2,2,3,3,4,4-fluorobutyl methyl ether; 1,1,1,2,2,3,3,4,4-fluorobutyl ethyl ether; perfluorodimethylcyclobutane; perfluoro-N-methylmorpholine; and 1,2,3,3,4,4-fluoro-1,2-trifluoromethyl cyclobutane. As used herein, cyclic perfluorinated hydrocarbons are meant to include perfluoromorpholine and perfluoro-N-alkyl morpholines where the allyl group has 1 to 3 carbons.

In the preferred spin fluid, the synthetic fiber-forming polyolefin is linear polyethylene. In the preferred spin fluid, the synthetic fiber-forming polyolefin concentration is in the range of 8 to 18 wt. % of the fluid. In the preferred spin fluid, the amount of co-solvent is sufficient to raise the cloud point pressure of the spin fluid by at least 200 psig.

BRIEF DESCRIPTION OF THE DRAWINGS

The accompanying drawings, which are incorporated in and constitute a part of this specification, illustrate the cloud point pressures for various spin fluids over a range of temperatures.

DETAILED DESCRIPTION OF THE INVENTION

The term "synthetic fiber-forming polyolefin" is intended to encompass the classes of polymers disclosed in the flash-spinning art.

The term "polyethylene" as used herein is intended to encompass not only homopolymers of ethylene, but also copolymers wherein at least 85% of the recurring units are ethylene units. One preferred polyethylene is linear high density polyethylene which has an upper limit melting range of about 130° to 140° C., a density in the range of 0.94 to 0.98 gram per cubic centimeter, and a melt index (as defined by ASTM D-1238-57T Condition E) of between 0.1 and 100, and preferably less than 4.

The term "polypropylene" is intended to embrace not only homopolymers of propylene but also copolymers where at least 85% of the recurring units are propylene units.

The term "plexifilamentary" as used herein, means a three-dimensional integral network of a multitude of thin, ribbon-like, film-fibril elements of random length and with a mean film thickness of less than about 4 microns and a median fibril width of less than about 25 microns. In plexifilamentary structures, the film-fibril elements are generally coextensively aligned with the longitudinal axis of the structure and they intermittently unite and separate at irregular intervals in various places throughout the length, width and thickness of the structure to form a continuous three-dimensional network.

The term "cloud-point pressure" as used herein, means the pressure at which a single phase liquid solution starts to phase separate into a polymer-rich/spin liquid-rich two-phase liquid/liquid dispersion.

To raise the cloud-point pressure, the co-solvent in the spin fluid must be a "non-solvent" for the polymer, or at least a poorer solvent than the primary solvent: i.e., methylene chloride or 1,2-dichloroethylene. (In other words, the solvent power of the co-solvent of the spin fluid used must be such that if the polymer to be flash-spun were to be dissolved in the co-solvent alone, the polymer would not dissolve in the co-solvent, or the resultant solution would have a cloud-point pressure greater than about 7000 psig.)

Methylene chloride and 1,2-dichloroethylene are such good solvents for the polyolefins that are commercially employed in the formation of flash-spun products (i.e., polyethylene and polypropylene) that the cloud-point pressure is so close to the bubble point that it is not possible to operate efficiently. By employing one of the co-solvents listed above, the solvent power of the mixture is lowered sufficiently that flash-spinning to obtain the desired plexifilamentary product is readily accomplished.

The apparatus and procedure for determining the cloud point pressures of a polymer/solvent combination are those described in the above cited U.S. Pat. No. 5,147,586 to Shin et al.

Figure 1:
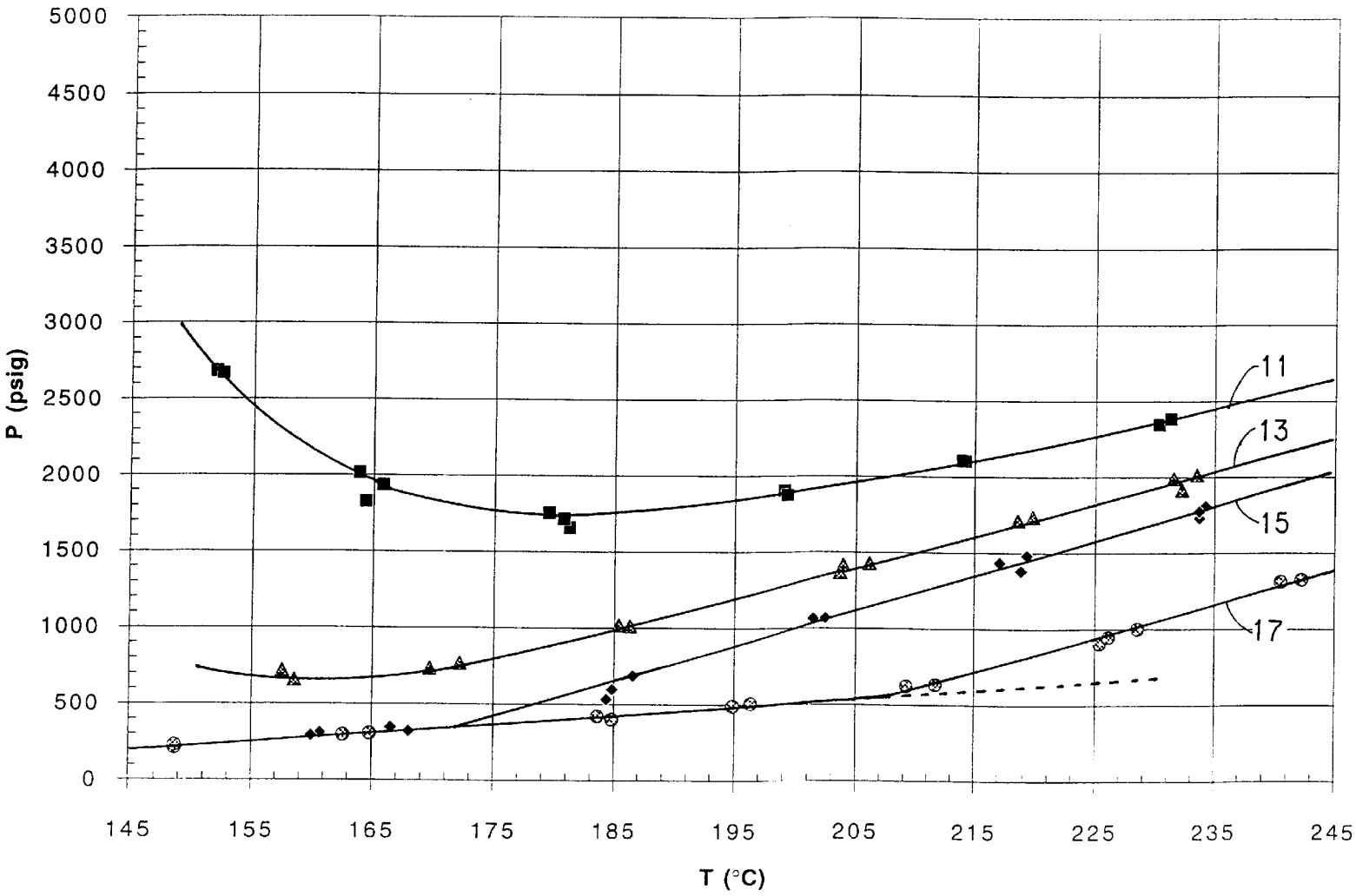
FIG. 1 is a plot of the cloud point data for a 12% by weight high density polyethylene solution in a solvent comprised of 100% methylene chloride or one of three mixtures of methylene chloride and 1-trifluoromethyl-1-fluoro-2,2-difluorocyclobutane.

FIG. 1 is a plot of the cloud point data for a 12% by weight high density polyethylene solution in a solvent comprised of either a mixture of methylene chloride and 1-trifluoromethyl-1-fluoro-2,2-difluorocyclobutane at 3 different solvent weight ratios (70/30, curve 11; 75/25, curve 13; and 80/20, curve 15) or 100% methylene chloride (curve 17). Where solvent ratios are expressed herein, the first number refers to weight percent of the methylene chloride or dichloroethylene primary solvent in the solvent mixture, and the second number refers to the weight percent of the co-solvent in the solvent mixture.

Figure 2:
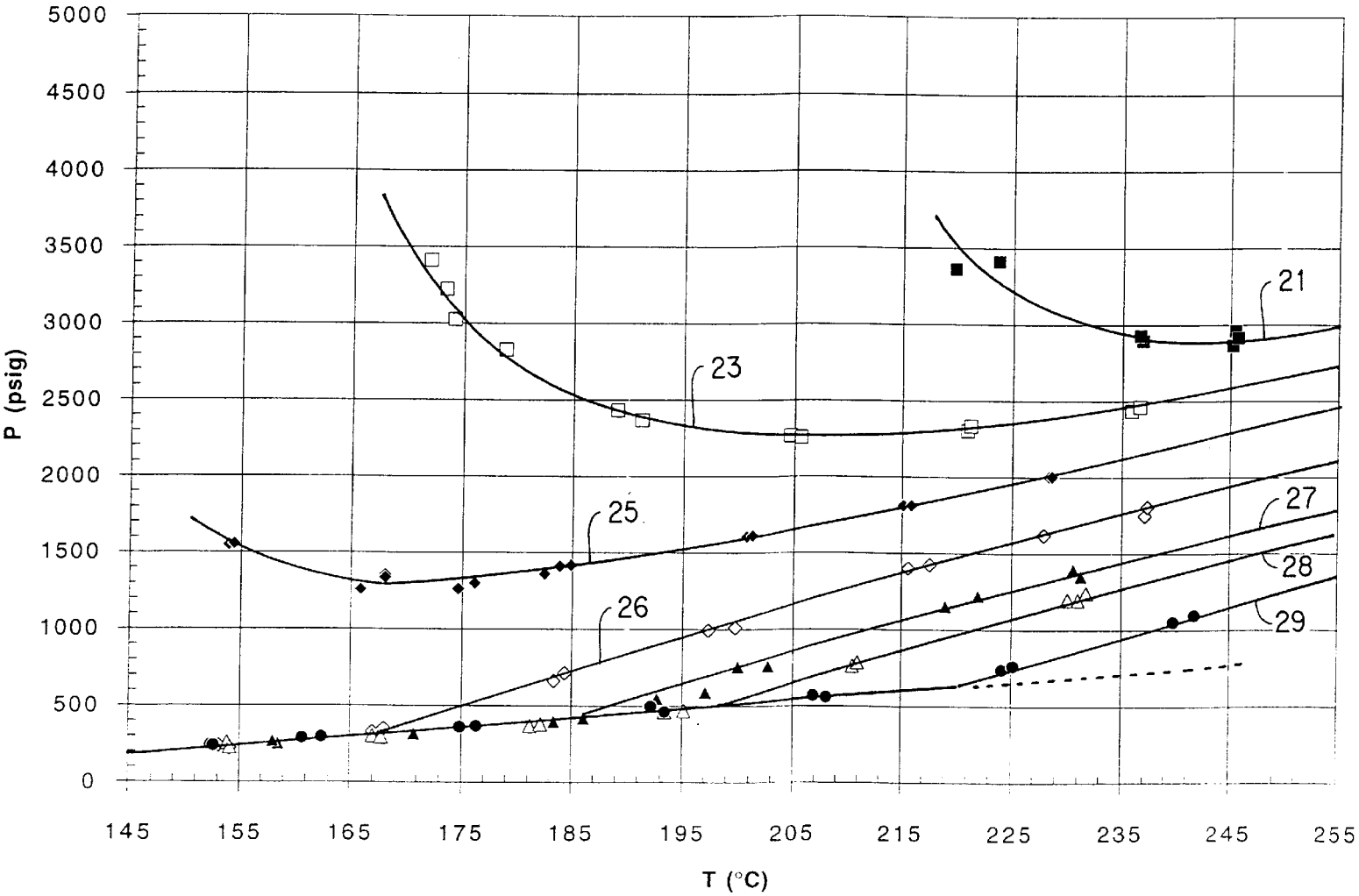
FIG. 2 is a plot of the cloud point data for a 9% by weight polypropylene solution in a solvent comprised of a mixture of 100% methylene chloride or one of six mixtures of methylene chloride and 1-trifuoromethyl-1-fluoro-2,2-difluorocyclobutane.

FIG. 2 is a plot of the cloud point data for a 9% by weight polypropylene solution in a solvent comprised of either a mixture of methylene chloride and 1-trifluoromethyl-1-fluoro-2,2-difluorocyclobutane at six different solvent weight ratios (30/70, curve 21; 35/65, curve 23; 40/60, curve 25; 50/50, curve 26; 60/40, curve 27; 70/30, curve 28) or 100% methylene chloride (curve 29).

Figure 3:
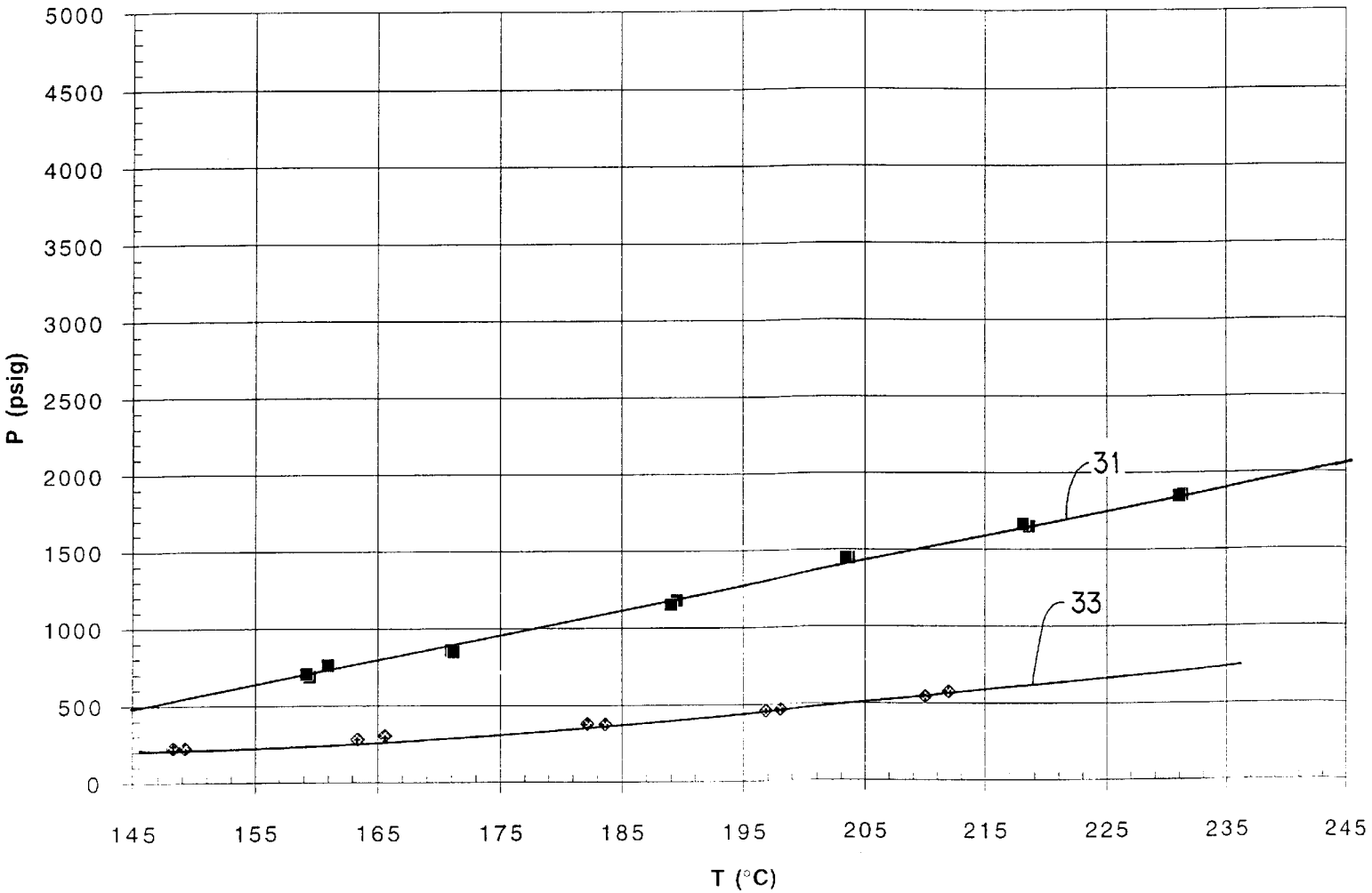
FIG. 3 is a plot of the cloud point data for a 12% by weight high density polyethylene solution in a solvent comprised of either a 70/30 mixture of 1,2-dichloroethylene and 1-trifluoromethyl-1-fluoro-2,2-difluorocyclobutane or 100% 1,2-dichloroethylene.

FIG. 3 is a plot of the cloud point data for a 12% by weight high density polyethylene solution in a solvent comprised of either a 70/30 mixture by weight of 1,2-dichloroethylene and 1-trifluoromethyl-1-fluoro-2,2-difluorocyclobutane (curve 31) or 100% 1,2-dichloroethylene (curve 33).

Figure 4:
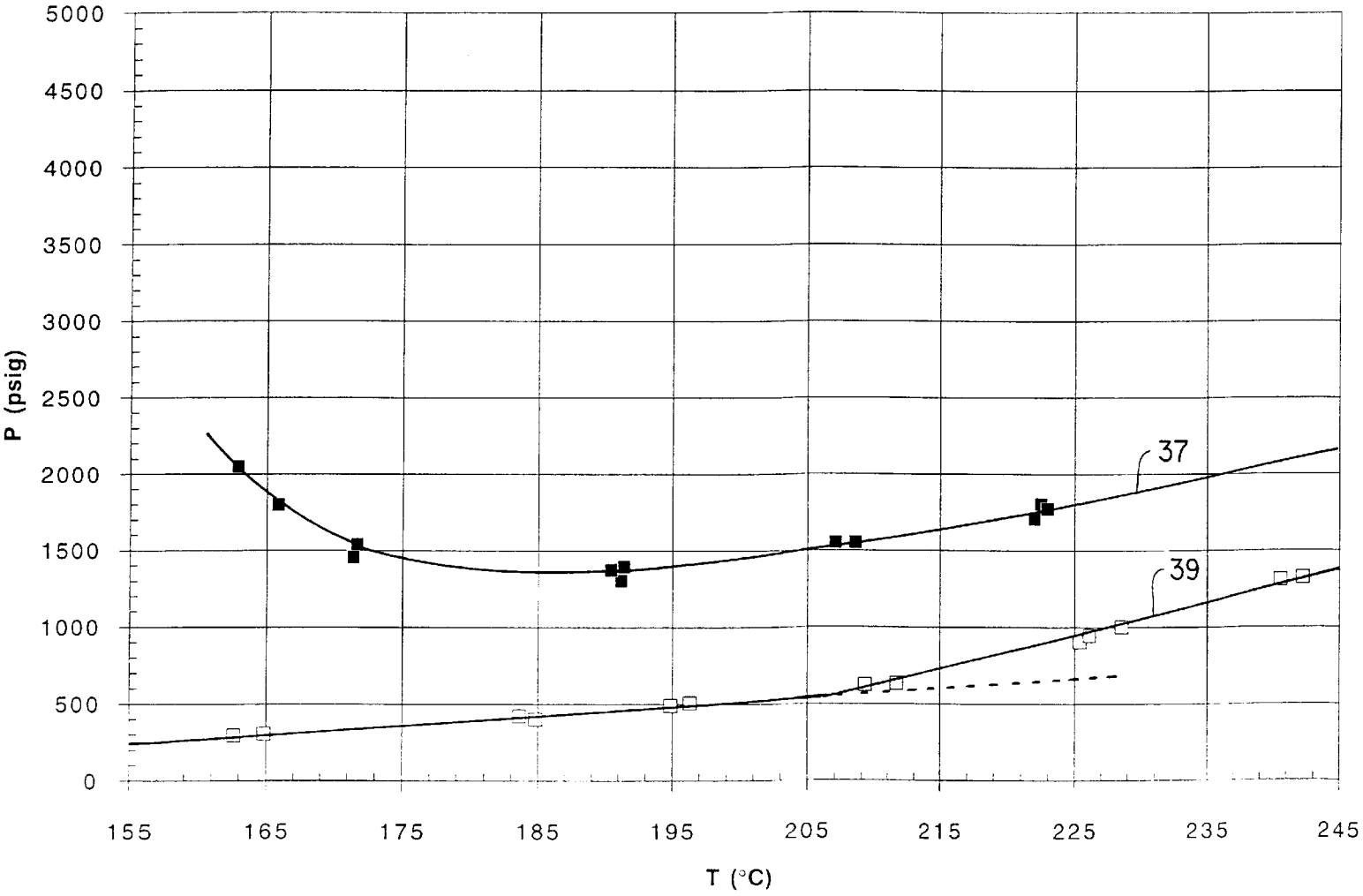
FIG. 4 is a plot of the cloud point data for a 12% by weight high density polyethylene solution in a solvent comprised of either a mixture of methylene chloride and 1,1,2,2,3,3-hexafluorocyclopentane or 100% methylene chloride.

FIG. 4 is a plot of the cloud point data for a 12% by weight high density polyethylene solution in a solvent comprised of either a 70/30 mixture by weight of methylene chloride and 1,1,2,2,3,3 hexafluorocyclopentane (HFC-C456ff) (curve 37) or 100% methylene chloride (curve 39).

Figure 5:
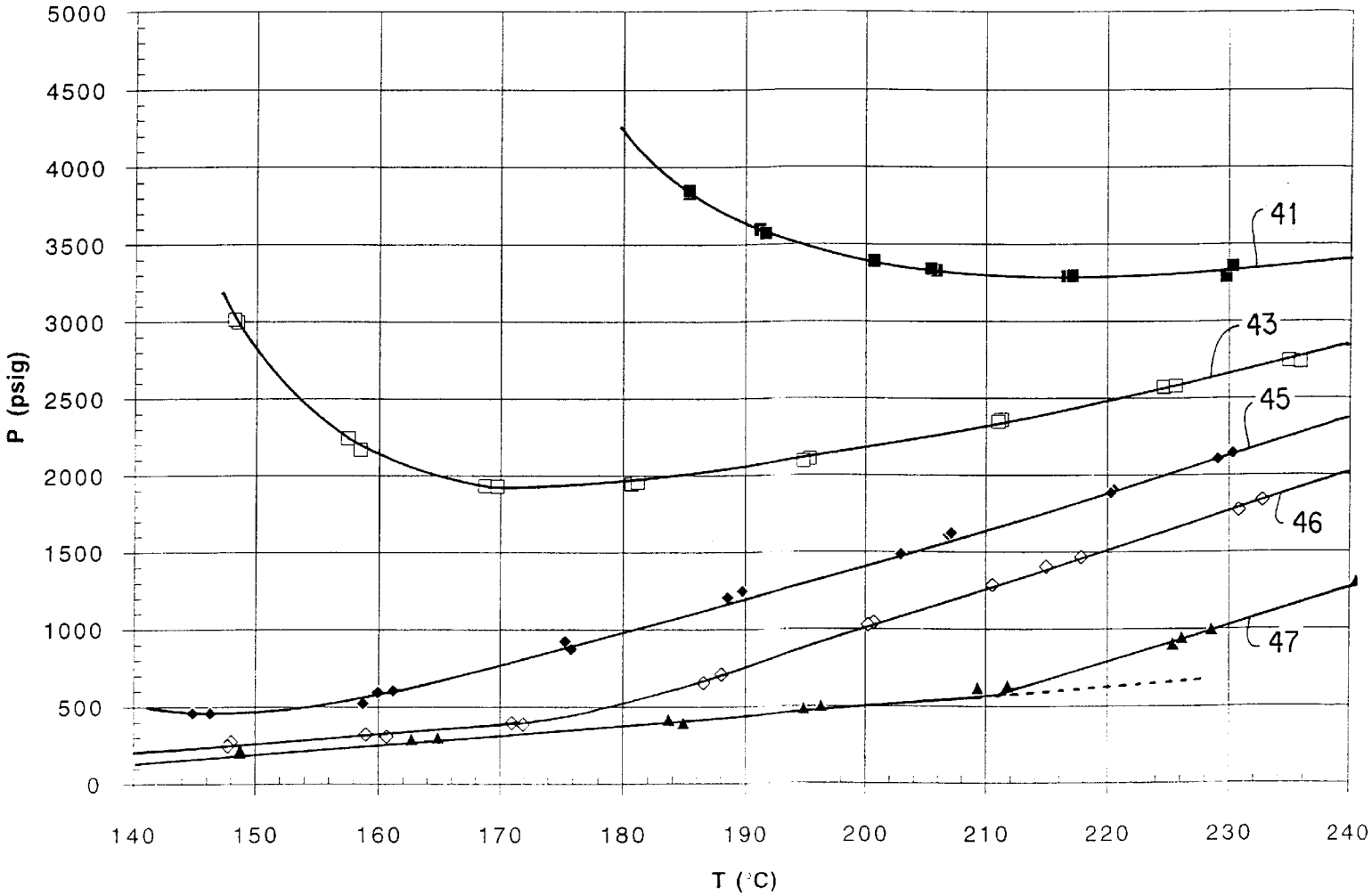
FIG. 5 is a plot of the cloud point data for a 12% by weight high density polyethylene solution in a solvent comprised of 100% methylene chloride or one of four mixtures of methylene chloride and 1,1,2,2,3,3,4,4-octafluorobutane.

FIG. 5 is a plot of the cloud point data for a 12% by weight high density polyethylene solution in a solvent comprised of either a mixture of methylene chloride and 1,1,2,2,3,3,4,5-octafluorobutane (HFC-338pcc) at one of four solvent weight ratios (70/30, curve 41; 75/25, curve 43; 80/20, curve 45; 85/15, curve 46) or 100% methylene chloride (curve 47).

Figure 6:
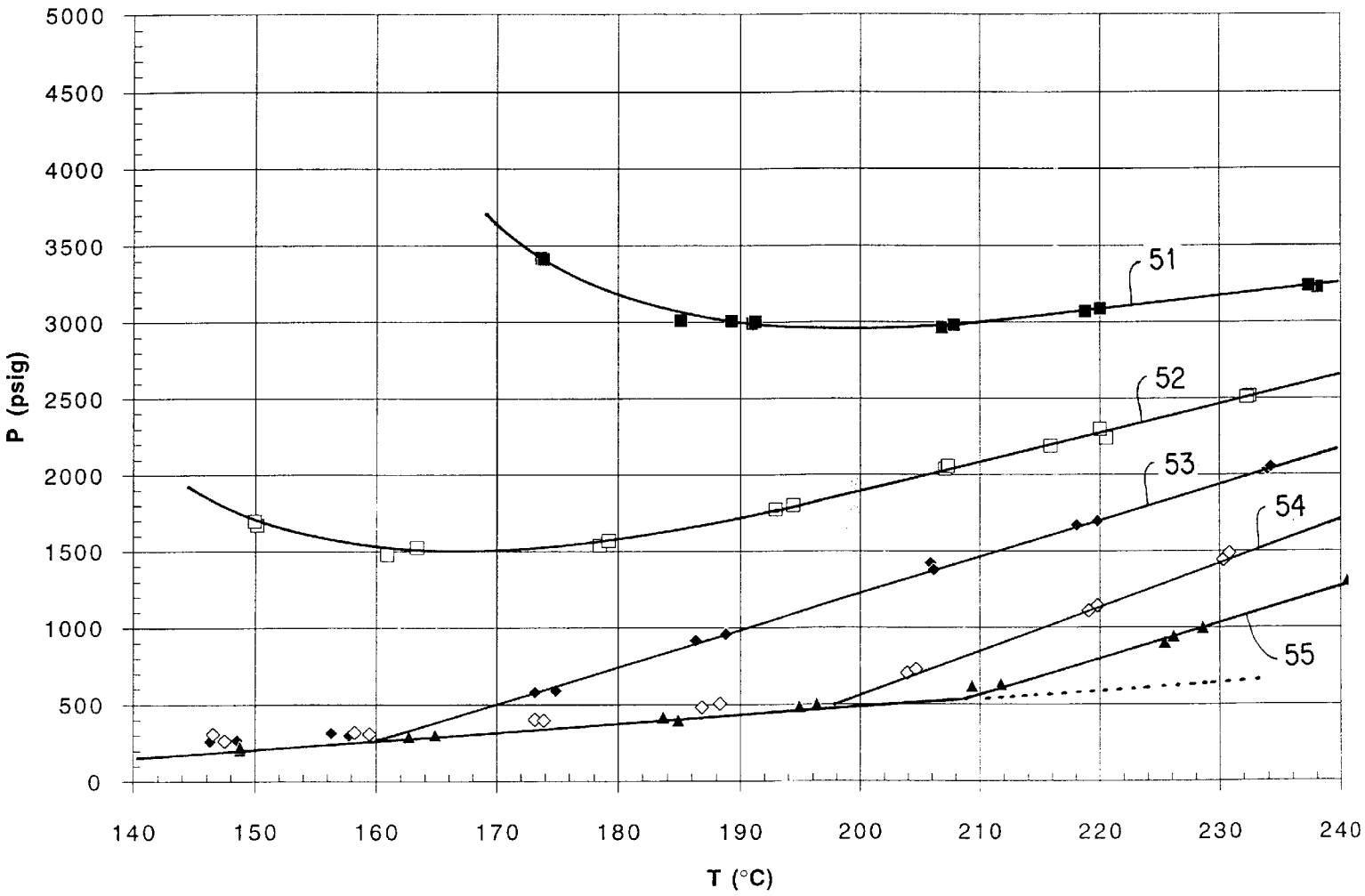
FIG. 6 is a plot of the cloud point data for a 12% by weight high density polyethylene solution in a solvent comprised of 100% methylene chloride or one of four mixtures of methylene chloride and 1,1,1,2,3,4,4,5,5,5-decafluoropentane.

FIG. 6 is a plot of the cloud point data for a 12% by weight high density polyethylene solution in a solvent comprised of either a mixture of methylene chloride and 1,1,1,2,3,4,4,5,5,5-decafluoropentane (HFC-43-10mee) at one of four different solvent weight ratios (75/25, curve 51; 80/20, curve 52; 85/15, curve 53; 90/10, curve 54) or 100% methylene chloride (curve 55).

Figure 7:
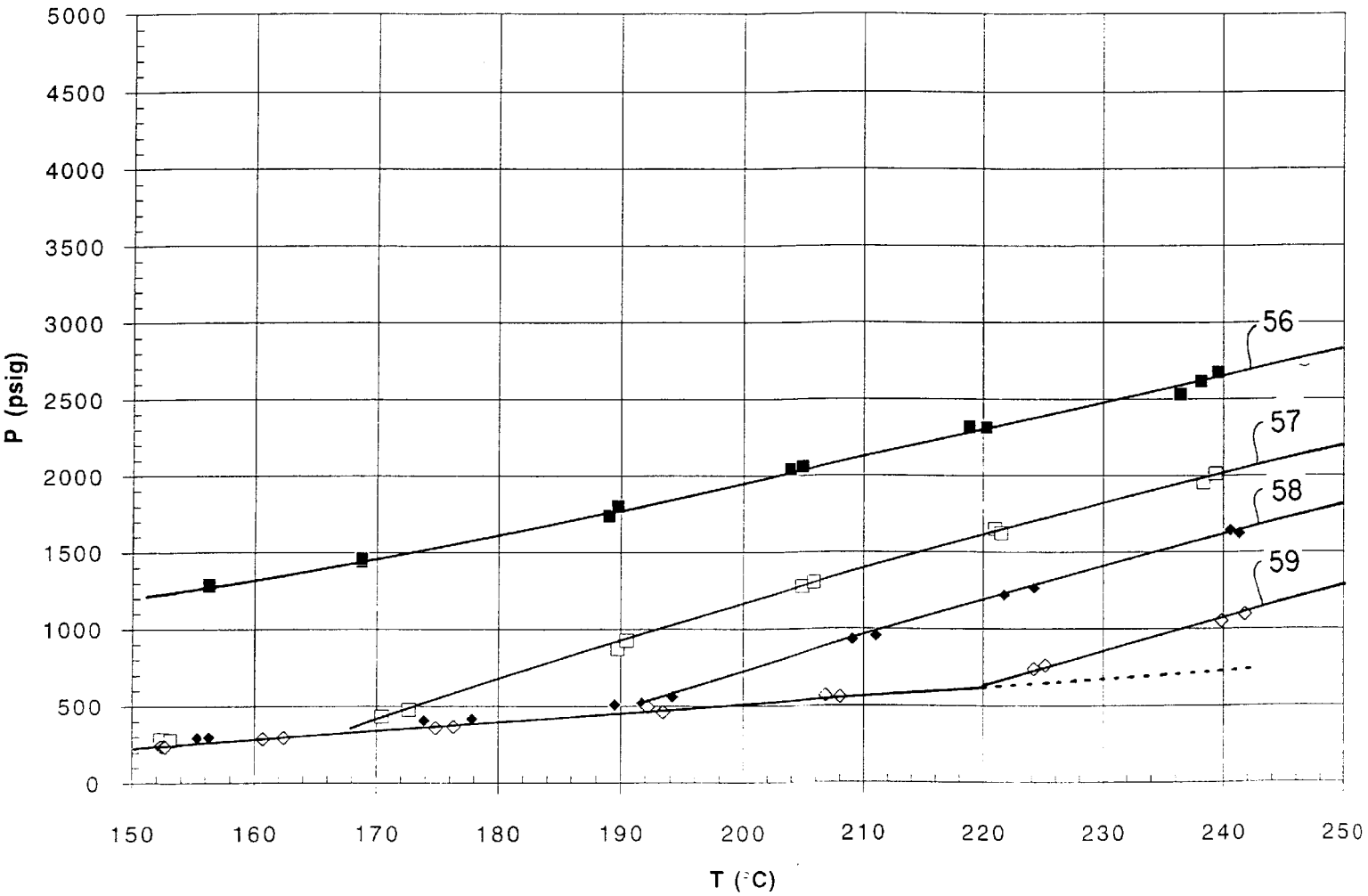
FIG. 7 is a plot of the cloud point data for a 9% by weight polypropylene solution in a solvent comprised of 100% methylene chloride or one of three mixtures of methylene chloride and 1,1,1,2,3,4,4,5,5,5 decafluoropentane.

FIG. 7 is a plot of the cloud point data for a 9% by weight polypropylene solution in a solvent comprised of either a mixture of methylene chloride and 1,1,1,2,3,4,4,5,5,5-decafluoropentane at one of three different solvent weight ratios (60/40, curve 56; 70/30, curve 57; 80/20, curve 58) or 100% methylene chloride (curve 59).

Figure 8:
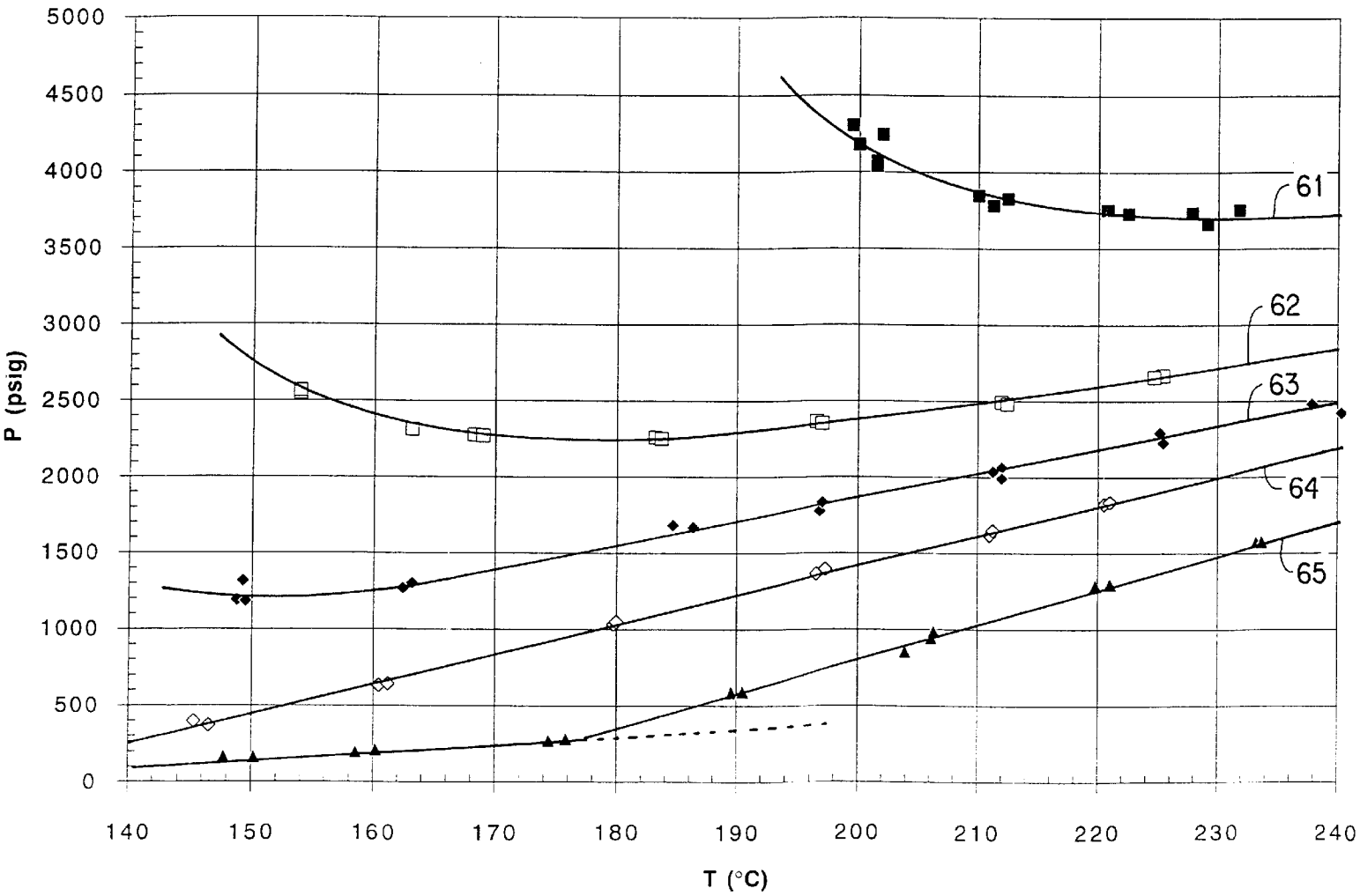
FIG. 8 is a plot of the cloud point data for a 12% by weight high density polyethylene solution in a solvent comprised of five different mixtures of 1,2-dichloroethylene and 1,1,1,2,3,4,4,5,5,5-decafluoropentane.

FIG. 8 is a plot of the cloud point data for a 12% by weight high density polyethylene solution in a solvent comprised of a mixture of 1,2-dichloroethylene and 1,1,1,2,3,4,4,5,5,5-decafluoropentane at one of five different solvent weight ratios (70/30, curve 61; 75/25, curve 62; 77.5/22.5, curve 63; 80/20, curve 64; 85/15, curve 65).

Figure 9:
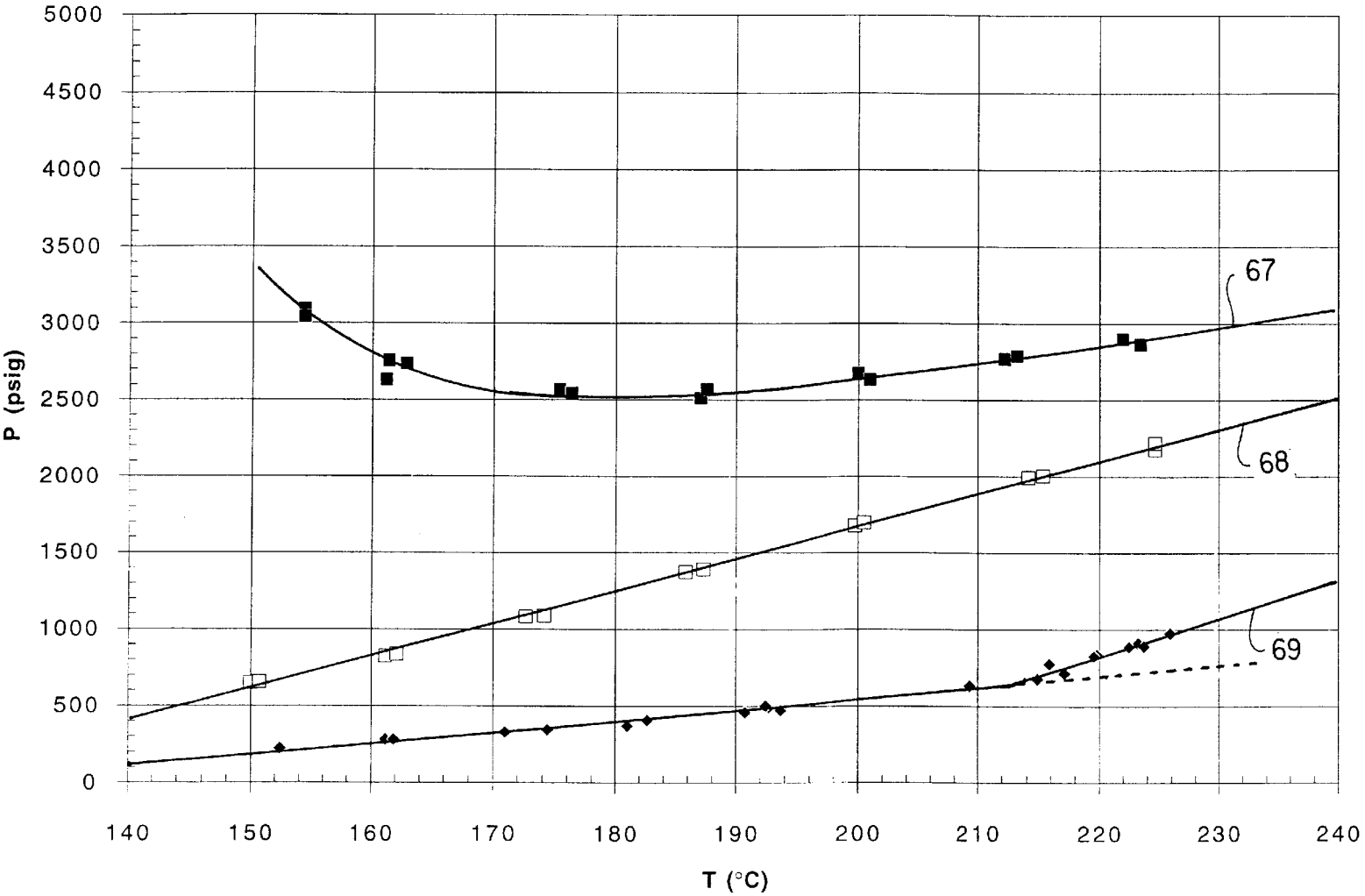
FIG. 9 is a plot of the cloud point data for a 12% by weight high density polyethylene solution in a solvent comprised of 100% methylene chloride or one of two mixtures of methylene chloride and 1,1,1,2,3,3-fluoropropyl 1,2,2,2-fluoroethyl ether.

FIG. 9 is a plot of the cloud point data for a 12% by weight high density polyethylene solution in a solvent comprised of either methylene chloride and 1,1,1,2,3,3-fluoropropyl 1,2,2,2-fluoroethyl ether (Freon® E-1) at two different solvent weight ratios (80/20, curve 67; 85/15, curve 68) or 100% methylene chloride (curve 69).

Figure 10:
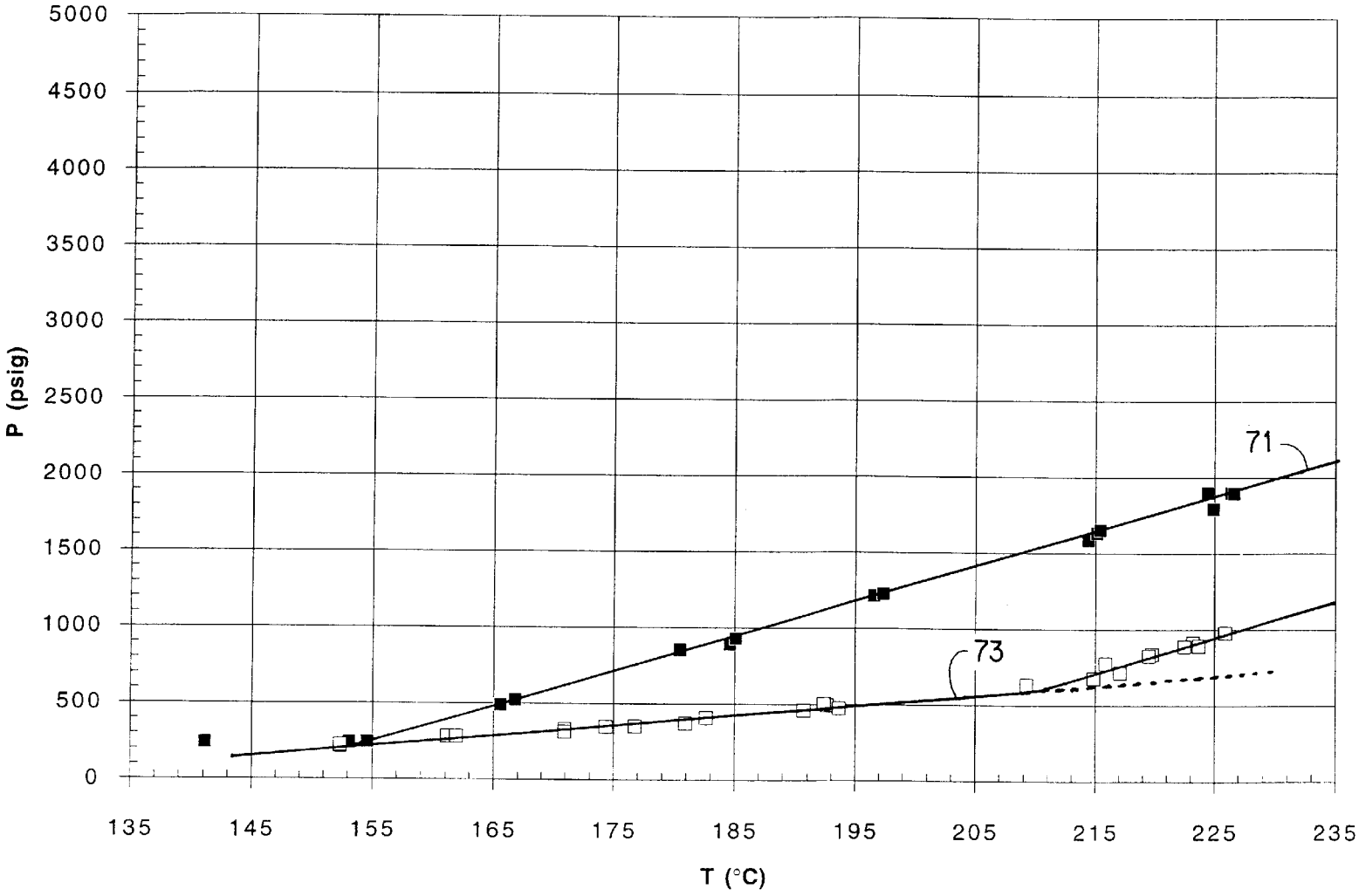
FIG. 10 is a plot of the cloud point data for a 12% by weight high density polyethylene solution in a solvent comprised of 100% methylene chloride or a mixture of methylene chloride and 1,1,1,2,3,3-fluoropropyl methyl ether.

FIG. 10 is a plot of the cloud point data for a 12% by weight high density polyethylene solution in a solvent comprised of either an 80/20 mixture of methylene chloride and 1,1,1,2,3,3-fluoropropyl methyl ether (HFOC-356) (curve 71) or 100% methylene chloride (curve 73).

Figure 11:
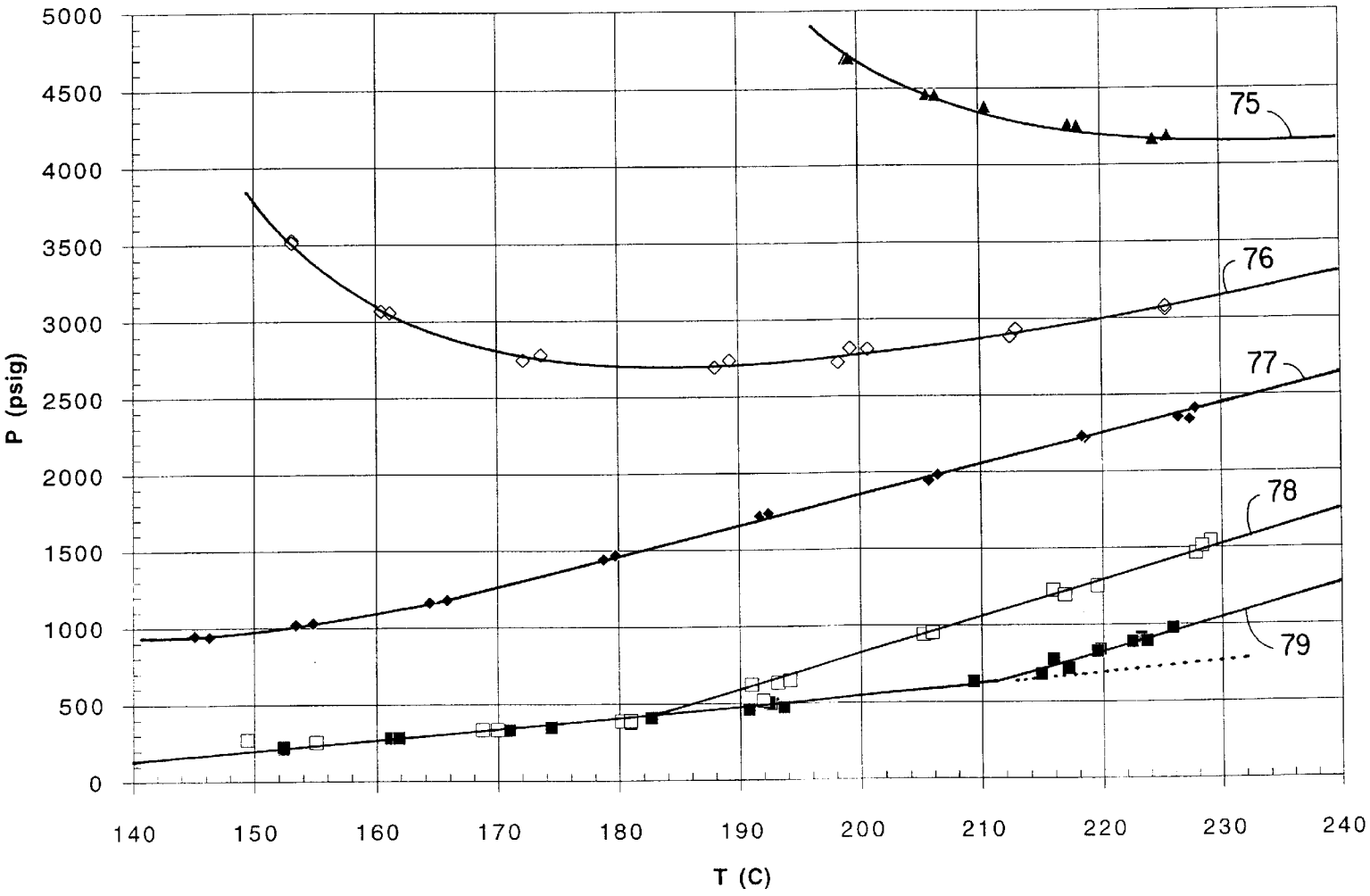
FIG. 11 is a plot of the cloud point data for a 12% by weight high density polyethylene solution in a solvent comprised of 100% methylene chloride or one of four mixtures of methylene chloride and perfluoro-N-methylmorpholine.

FIG. 11 is a plot of the cloud point data for a 12% by weight high density polyethylene solution in a solvent comprised of either methylene chloride and perfluoro-N-methylmorpholine (PF5052) at four different solvent weight ratios (70/30, curve 75; 75/25, curve 76; 80/20, curve 77; 90/10, curve 78) or 100% methylene chloride (curve 79).

Figure 12:
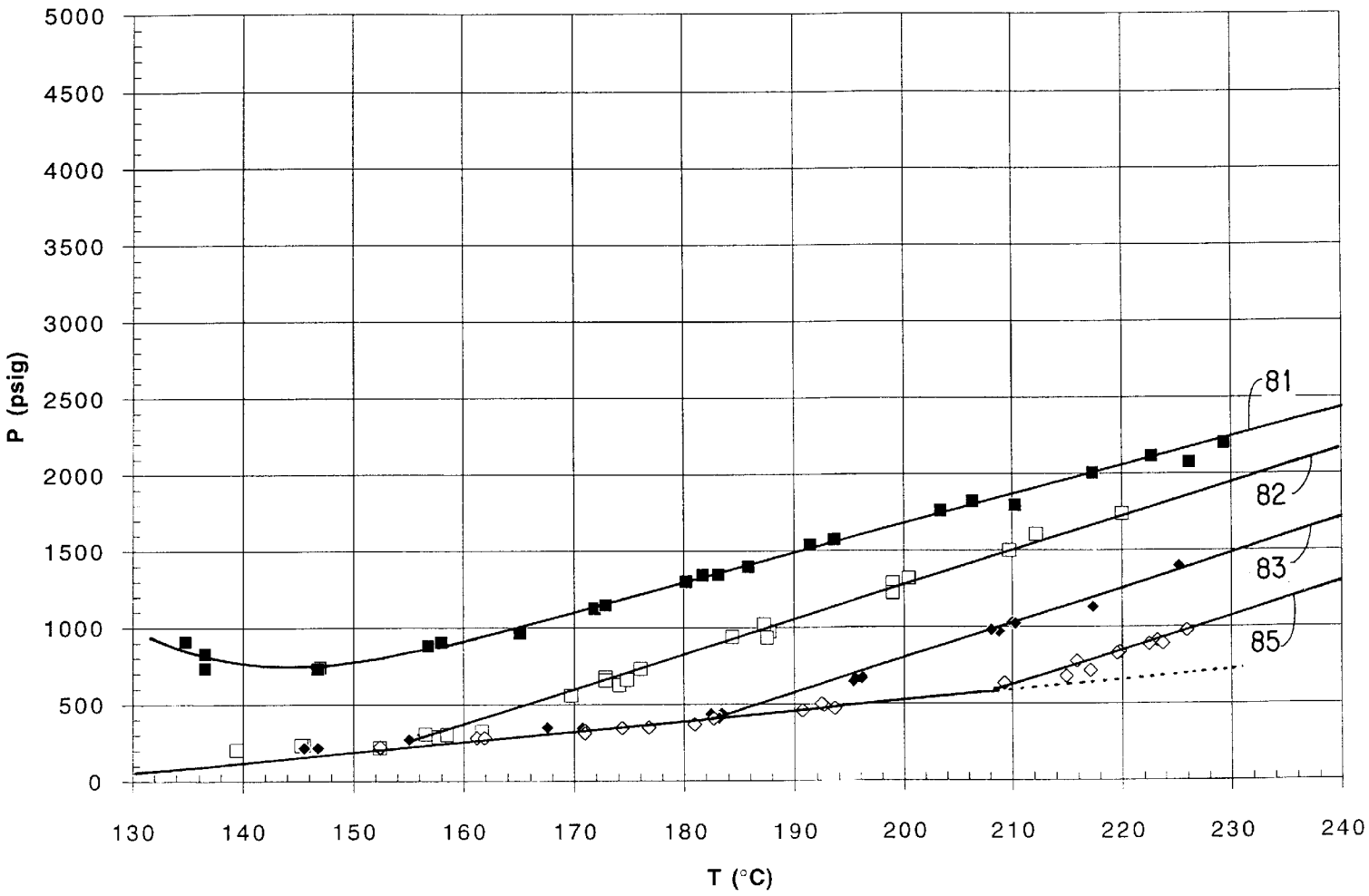
FIG. 12 is a plot of the cloud point data for a 12% by weight high density polyethylene solution in a solvent comprised of 100% methylene chloride or one of three mixtures of methylene chloride and perfluorodimethylcyclobutane.

FIG. 12 is a plot of the cloud point data for a 12% by weight high density polyethylene solution in a solvent comprised of either methylene chloride and perfluorodimethylcyclobutane (Vertrel 245) at three different solvent weight ratios (80/20, curve 81; 85/15, curve 82; 90/10, curve 83) or 100% methylene chloride (curve 85).

Figure 13:
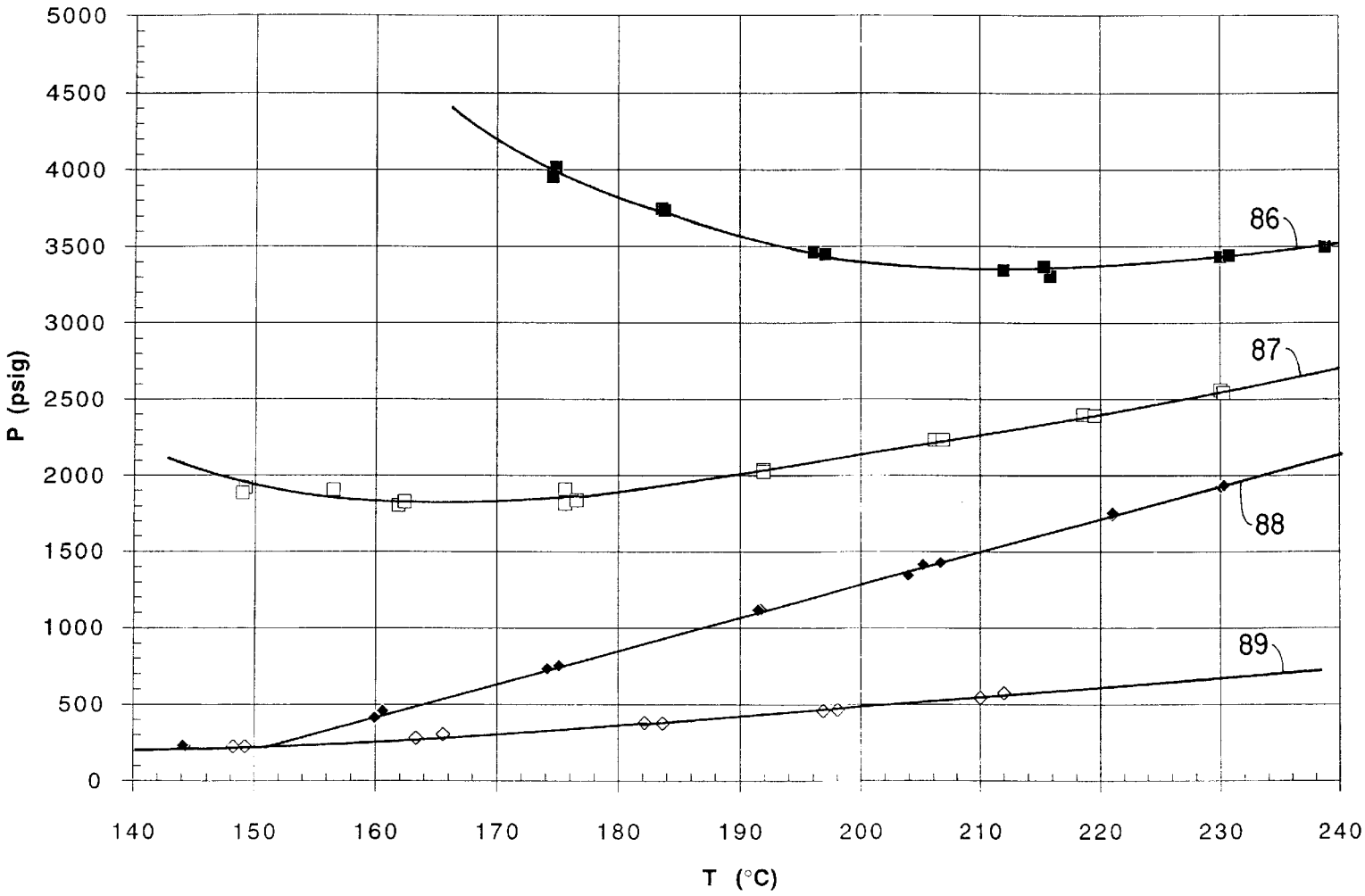
FIG. 13 is a plot of the cloud point data for a 12% by weight high density polyethylene solution in a solvent comprised of 100% trans-1,2-dichloroethylene or one of three mixtures of trans-1,2-dichloroethylene and 1,1,1,2,2,3,3-fluoropropyl 1,2,2,2-fluoroethyl ether.

FIG. 13 is a plot of the cloud point data for a 12% by weight high density polyethylene solution in a solvent comprised of either trans-1,2-dichloroethylene and the co-solvent 1,1,1,2,2,3,3-fluoropropyl 1,2,2,2-fluoroethyl ether (Freon® E-1) at three different solvent weight ratios (75/25, curve 86; 80/20, curve 87; 85/15, curve 88) or 100% trans-1,2-dichloroethylene (curve 89).

Figure 14:
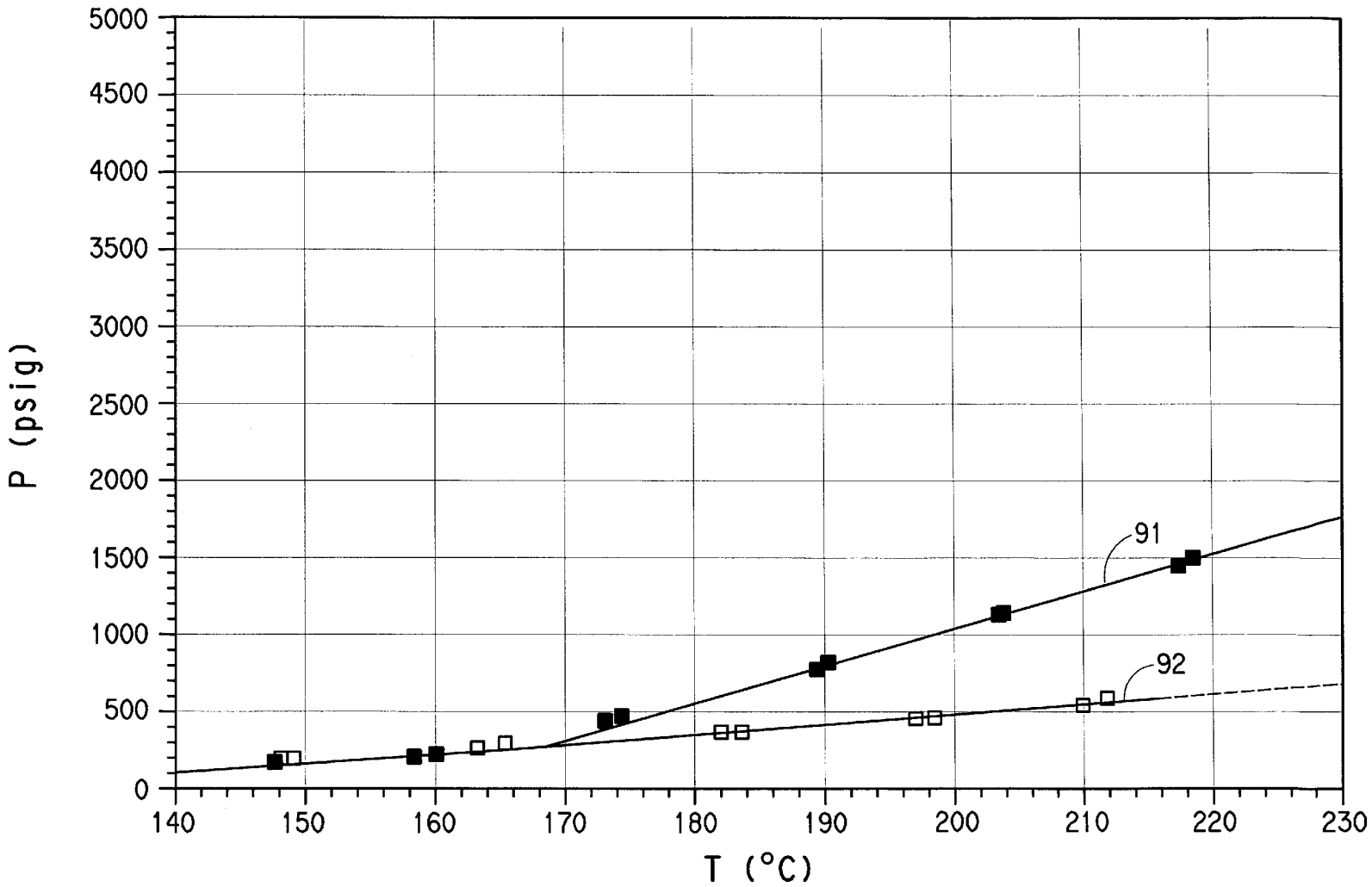
FIG. 14 is a plot of the cloud point data for a 12% by weight high density polyethylene solution in a solvent comprised of 100% trans-1,2-dichloroethylene or a mixture of trans-1,2-dichloroethylene and the co-solvent perfluoro-N-methylmorpholine.

FIG. 14 is a plot of the cloud point data for a 12% by weight high density polyethylene solution in a solvent comprised of either an 82.5/17.5 mixture of trans-1,2-dichloroethylene and the co-solvent perfluoro-N-methylmorpholine (PF5052) (curve 91) or 100% trans-1,2-dichloroethylene (curve 92).

Figure 15:
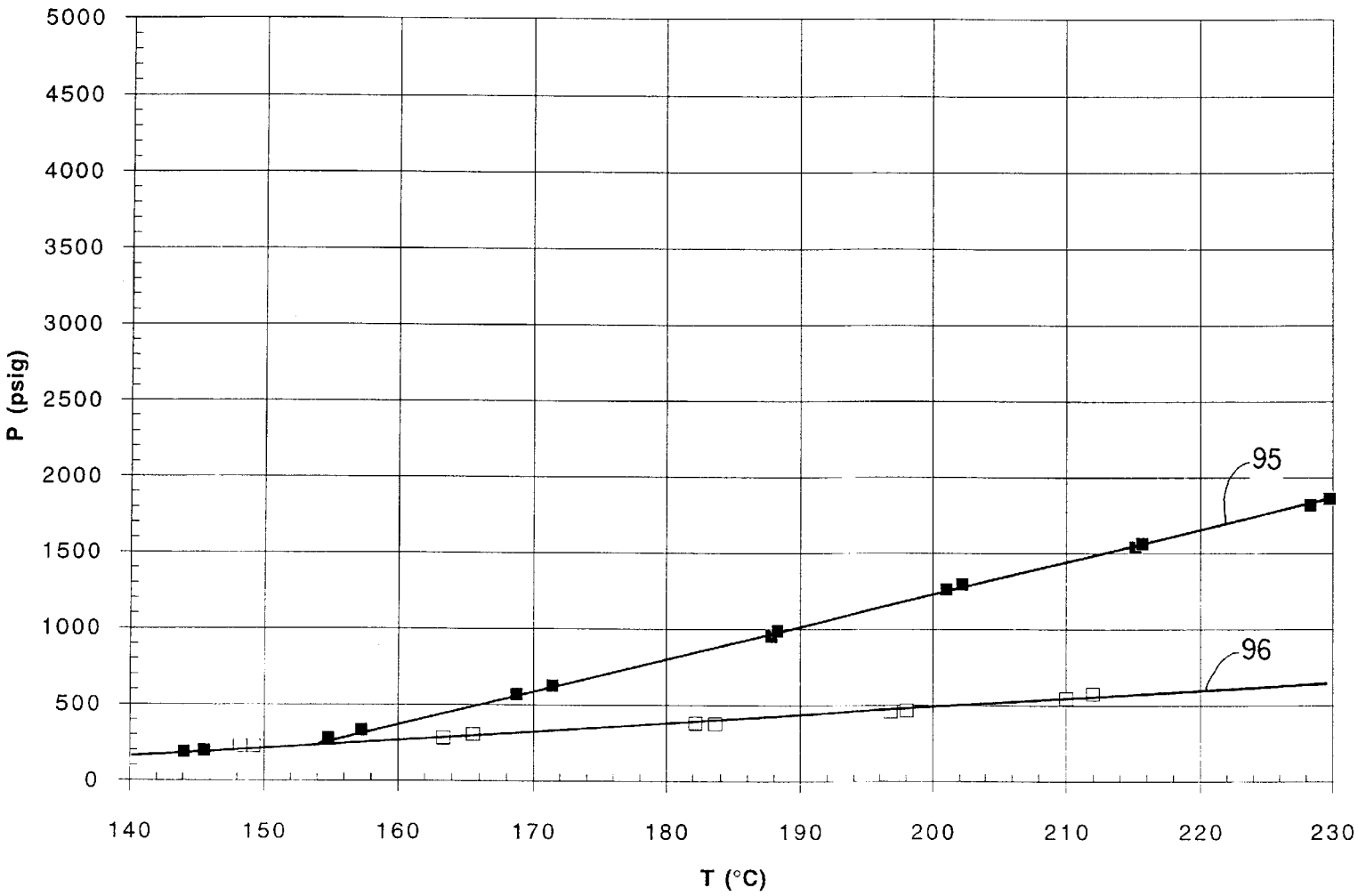
FIG. 15 is a plot of the cloud point data for a 12% by weight high density polyethylene solution in a solvent comprised of 100% trans-1,2-dichloroethylene or a mixture of trans-1,2-dichloroethylene and the co-solvent perfluorodimethyl-cyclobutane.

FIG. 15 is a plot of the cloud point data for a 12% by weight high density polyethylene solution in a solvent comprised of either an 82.5/17.5 trans-1,2-dichloroethylene and the co-solvent perfluorodimethyl-cyclobutane (Vertrel 245) (curve 95) or 100% trans-1,2-dichloroethylene (curve 96).

In order to spread the web formed when polymers are flash-spun in the commercial operations, the flash-spun material is projected against a rotating baffle: see, for example, Brethauer et al. U.S. Pat. No. 3,851,023, and then subjected to an electrostatic charge. The baffle causes the product to change directions and start to spread, and the electrostatic charge causes the product (web) to further spread. In order to achieve a satisfactory commercial product in a commercially acceptable time, it is necessary that the web achieve a significant degree of spread, and this can be best achieved if sufficient electrostatic charge remains on the web for the desired time. The charge will dissipate too rapidly if the atmosphere surrounding the web has too low a dielectric strength. A major component of the atmosphere surrounding the web is the vaporized solvents that, prior to flash-spinning, dissolved the polymer which was flash-spun. The mixtures of a primary solvent selected from the group consisting of methylene chloride and 1,2-dichloroethylene and the co-solvents listed above, when vaporized, have a dielectric strength sufficient to maintain sufficient electric charge on the web to insure a satisfactory product. These mixtures have a dielectric strength as measured by ASTM D-2477 of greater than about 40 kilovolts per centimeter.

Because the mixture of solvents has a boiling point that is near room temperature, a high pressure solvent recovery system is not necessary; and furthermore, a high pressure solvent injection system is not necessary. The solvent mixtures of the present invention are also of low flammability.

The amount of co-solvent employed with the primary solvent selected from the group consisting of methylene chloride and 1,2-dichloroethylene will usually be in the range of about 10 to 50 parts by weight per hundred parts by weight of the solvent mixture. Due to the relatively high toxicity of methylene chloride and the slight flammability of 100% dichloroethylene, it is advantageous for the solvent mixture to comprise a high proportion of the more benign co-solvent. Dilution with the co-solvent reduces the toxicity and flammability concerns associated with the primary solvents. However, high proportions of many potential co-solvents raise the cloud point pressure of the spin solution too high for commercial flash-spinning processes. It has been found that partially fluorinated cyclic co-solvents of the invention are especially effective in the spin solution because such co-solvents can be used at relatively high concentrations without raising the cloud point pressure of the spin solution above the point where commercial flash-spinning is practical.

For example, a spin solution comprised of 12% polyethylene in a solvent mixture of 70 parts by weight methylene chloride and 30 parts 1-trifluoromethyl-1-fluoro-2,2-difluorocyclobutane has a cloud point pressure of about 1900 psig at 200° C. (see FIG. 1, Curve 11). When the 1-trifluoromethyl-1-fluoro-2,2-difluorocyclobutane is replaced with the same concentration of another cyclic partially fluorinated co-solvent, 1,1,2,2,3,3-hexafluorocyclopentane, the cloud point pressure is about 1400 psig at 200° C. (see FIG. 4, Curve 37). If, on the other hand, the co-solvent is replaced with the same concentration of the straight chain 1,1,2,2,3,3,4,4-octafluorobutane, the cloud point pressure rises to 3400 psig at 200° C. (see FIG. 5, Curve 41). Similarly, if the co-solvent is replaced with the straight chain 1,1,1,2,3,4,4,5,5,5-decafluoropentane, the cloud point pressure would rise to more than 3000 psig at 200° C. (see FIG. 6).

The same benefits can be observed with a spin solution of 9% polypropylene in a solvent mixture comprised of 60 parts by weight methylene chloride and 40 parts of a co-solvent. When the co-solvent is 1-trifluoromethyl-1-fluoro-2,2-difluorocyclobutane, the cloud point pressure of the solution at 200° C. is about 750 psig (see FIG. 2, Curve 27). If, on the other hand, the 1-trifluoromethyl-1-fluoro-2,2-difluorocyclobutane is replaced with the straight chain 1,1,1,2,3,4,4,5,5,5-decafluoropentane, the cloud point pressure rises to about 1900 psig at 200° C. (see FIG. 7, Curve 56).

Likewise, the advantages of using partially fluorinated cyclic co-solvents are apparent when the primary solvent is dichloroethylene. With a spin solution of 12% polyethylene in a solvent mixture comprised of 70 parts by weight dichloroethylene and 30 parts 1-trifluoromethyl-1-fluoro-2,2-difluorocyclobutane co-solvent, the cloud point pressure of the solution at 200° C. is about 1300 psig (see FIG. 3, Curve 31). If the 1-trifluoromethyl-1-fluoro-2,2-difluorocyclobutane co-solvent is replaced with the straight chain 1,1,1,2,3,4,4,5,5,5-decafluoropentane, the cloud point pressure rises to about 4000 psig at 200° C. (see FIG. 8, Curve 61).

This invention will now be illustrated by the following non-limiting examples which are intended to illustrate the invention and not to limit the invention in any manner.

Test Methods

The tenacity of the flash-spun strand is determined with an Instron tensile-testing machine. The strands are conditioned and tested at 70° F. and 65% relative humidity. The sample is then twisted to 10 turns per inch and mounted in jaws of the Instron Tester. A 2-inch gauge length and an elongation rate of 100% per minute are used. The tenacity (T) at break is recorded in grams per denier.

The Elongation of the flash-spun strand is measured as elongation at break and is reported as a percentage.

The Modulus corresponds to the slope of the stress/strain curve and is expressed in units of gpd.

The Denier of the strand is determined from the weight of a 18 cm sample length of the strand.

The surface area of the plexifilamentary film-fibril strand product is a measure of the degree and fineness of fibrillation of the flash-spun product. Surface area is measured by the BET nitrogen absorption method of S. Brunauer, P. H. Emmett and E. Teller, J. Am. Chem. Soc., V. 60 p 309–319 (1938) and is reported as $m^2/g$.

Test Procedure

The apparatus and process for carrying out the examples is as described in U.S. Pat. No. 5,250,237 at column 10 and following. U.S. Pat. No. 5,250,237 is incorporated herein by reference. The spinneret employed had an orifice with a 30 mil diameter and a 30 mil length.

EXAMPLE 1

12 wt. % high density polyethylene having a melt index of 0.75 was dissolved in a mixture of methylene chloride and 1,1,1,2,2,3,3-fluoropropyl 1,2,2,2-fluoroethyl ether in which the weight percent ratio of primary solvent, methylene chloride to the ether was 75/25 at 210° C. and a pressure of 4000 psig. The solution was spun at an accumulator pressure of 2500 psig and at a spin pressure of 2340 psig at 210° C. The presence of the co-solvent raised the cloud point pressure of the spin fluid by about 2000 psig (See FIG. 9; curve 67). A plexifilamentary product was obtained having a denier of 296, a tenacity of 3.8 grams per denier, and a percent elongation at break of 80.

EXAMPLE 2

The process of Example 1 was repeated using as the primary solvent methylene chloride and the co-solvent was 1,1,1,2,3,3-fluoropropyl methyl ether, and the weight percent ratio of methylene chloride to ether was 80/20, the polyethylene was dissolved at 1400 psig, and spun at 1410 psig. The presence of the co-solvent raised the cloud point pressure of the spin fluid by about 900 psig (See FIG. 10; curve 71). The product was a plexifilament having a denier of 266, a tenacity of 2.35 grams per denier, and an elongation at break of 99%.

EXAMPLE 3

The process of Example 1 was repeated except the co-solvent was perfluoro-N-methylmorpholine, and the weight percent ratio of methylene chloride to co-solvent was 80/20, the polyethylene was dissolved at 200° C. and at a pressure of 3000 psig, and spun at an accumulator pressure of 1000 psig and at a spin pressure of 950 psig at 200° C. The presence of the co-solvent raised the cloud point pressure of the spin fluid by more than 1200 psig (See FIG. 11; curve 77). The product was a plexifilament having a denier of 197, a tenacity of 4.5 grams per denier, and a percent elongation at break of 66.

EXAMPLE 4

The process of Example 1 was repeated except that the co-solvent was perfluorodimethylcyclobutane, and the weight percent ratio of methylene chloride to co-solvent was 80/20, and the polyethylene was dissolved at 200° C. at a pressure of 2500 psig, and spun at 200° C. using an accumulator pressure of 1600 psig and at actual spin pressure of 1480 psig. The presence of the co-solvent raised the cloud point pressure of the spin fluid by more than 1200 psig (See FIG. 12; curve 81). The product was a plexifilament and had a denier of 306, a tenacity of 3.3 grams per denier, and an elongation at break of 83%.

EXAMPLE 5

The process of Example 1 was repeated using as the primary solvent trans-1,2-dichloroethylene, and the co-solvent was 1,1,1,2,2,3,3-fluoropropyl 1,2,2,2-fluoroethyl ether. 12 wt. % of the polyethylene was dissolved in a mixture of the solvents. The solvent was of 85 wt. % primary solvent and 15 wt. % co-solvent. The polymer was mixed at 210° C. and 2000 psig and spun at 1400 psig accumulator pressure. The presence of the co-solvent raised the cloud point pressure of the spin fluid by about 1000 psig (See FIG. 13; curve 88). Actual spin pressure during spinning was 1300 psig. The product was a plexifilament with a denier of 233, a tenacity of 1.93 grams per denier, and an elongation at break of 100%.

EXAMPLE 6

12 wt. % high density polyethylene (melt index of 0.75) was dissolved in 82.5 wt. % trans-1,2-dichloroethylene and 17.5 wt. % perfluoro-N-methylmorpholine. The polymer and solvent were mixed at 210° C. at 2500 psig for 30 minutes, and spun at 211° C. at an accumulator pressure of 1300 psig, and at actual spin pressure of 1000 psig. The presence of the co-solvent raised the cloud point pressure of the spin fluid by about 600 psig (See FIG. 14; curve 91). The product had a denier of 237, a tenacity of 1.63 grams per denier, and an elongation at break of 122%.

EXAMPLE 7

12 wt. % high density polyethylene (melt index of 0.75) was dissolved in 82.5 wt. % trans-1,2-dichloroethylene and 17.5 wt. % perfluorodimethyl-cyclobutane. The polymer and solvent were mixed at 200° C. at 2500 psig for 30 minutes, and spun at 200° C. at an accumulator pressure of 900 psig, and at actual spin pressure of 700 psig. The presence of the co-solvent raises the cloud point pressure of the spin fluid by about 750 psig (See FIG. 15; curve 95). The product had a denier of 168, a tenacity of 2.08 grams per denier, and an elongation at break of 120%.

EXAMPLE 8

12 wt. % high density polyethylene having a melt index of 0.75 was dissolved in a mixture of methylene chloride and 1-trifluoromethyl-1-fluoro-2,2-difluorocyclobutane in which the weight percent ratio of the primary solvent, methylene chloride, to the co-solvent, 1-trifluoromethyl-1-fluoro-2,2-difluorocyclobutane, was 75/25. The distearyl pentaerythritol diphosphite stabilizer Weston 619F, sold by GE Specialty Chemicals, was included in the solvent mixture at a concentration of 0.1 wt.% of the solvent mixture. The 1-trifluoromethyl-1-fluoro-2,2-difluorocyclobutane has an atmospheric boiling point of about 68° C. The polyethylene and solvent were mixed at 190° C. and a pressure of 2000 psig for 45 minutes. The solution was spun at an accumulator pressure of 900 psig, at a spin pressure of about 800 psig, and at a temperature of 190° C. through the spin orifice. The presence of the co-solvent raised the cloud point of the spin fluid by about 750 psig (See FIG. 1; curve 13). A well fibrillated plexifilamentary product was obtained having a denier of 174, a modulus of 12.5 gpd, a tenacity of 5.4 gpd, an elongation of 93% and a surface area of 21.2 $m^2/g$.

EXAMPLE 9

12 wt. % high density polyethylene having a melt index of 0.75 was dissolved in a mixture of 1,2-dichloroethylene and 1-trifluoromethyl-1-fluoro-2,2-difluorocyclobutane in which the weight percent ratio of the primary solvent, dichloroethylene, to the co-solvent, 1-trifluoromethyl-1-fluoro-2,2-difluorocyclobutane, was 70/30. The distearyl pentaerythritol diphosphite stabilizer, Weston 619F was included in the solvent mixture at a concentration of 0.1 wt.% of the solvent mixture. The polyethylene and solvent were mixed at 210° C. and a pressure of 2000 psig for 30 minutes. The solution was spun at an accumulator pressure of 1300 psig, at a spin pressure of about 1200 psig, and at a temperature of 210° C. through the spin orifice. The presence of the co-solvent raised the cloud point of the spin fluid by about 750 psig (See FIG. 3). A well fibrillated plexifilamentary product was obtained having a denier of 172, a modulus of 7.3 gpd, a tenacity of 3.9 gpd, and an elongation of 82%.

EXAMPLE 10

12 wt. % high density polyethylene having a melt index of 0.75 was dissolved in a mixture of methylene chloride and 1,1,2,2,3,3-hexafluorocyclopentane in which the weight percent ratio of the primary solvent, methylene chloride, to the co-solvent, 1,1,2,2,3,3-hexafluorocyclopentane, was 70/30. The distearyl pentaerythritol diphosphite stabilizer, Weston 619F was included in the solvent mixture at a concentration of 0.1 wt.% of the solvent mixture. The 1,1,2,2,3,3-hexafluorocyclopentane has an atmospheric boiling point of about 80° C. The polyethylene and solvent were mixed at 200° C. and a pressure of 2500 psig for 30 minutes. The solution was spun at an accumulator pressure of 1000 psig, at a spin pressure of about 800 psig, and at a temperature of 200° C. through the spin orifice. The presence of the co-solvent raised the cloud point of the spin fluid by about 800 psig (See FIG. 4, curve 37). A well fibrillated plexifilamentary product was obtained having a denier of 239, a modulus of 10.9 gpd, a tenacity of 5.1 gpd, and an elongation of 73%.

EXAMPLE 11

8 wt. % polypropylene having a melt flow rate of 1.43 and a molecular weight distribution of 4.77 was dissolved in a mixture of methylene chloride and 1-trifluoromethyl-1-fluoro-2,2-difluorocyclobutane in which the weight percent ratio of the primary solvent, methylene chloride, to the co-solvent, 1-trifluoromethyl-1-fluoro-2,2-difluorocyclobutane, was 60/40. The distearyl pentaerythritol diphosphite stabilizer, Weston 619F was included in the solvent mixture at a concentration of 0.1 wt.% of the solvent mixture. The polypropylene and solvent were mixed at 220° C. and a pressure of 2500 psig for 30 minutes. The solution was spun at an accumulator pressure of 1000 psig, at a spin pressure of about 875 psig, and at a temperature of 220° C. through the spin orifice. The presence of the co-solvent raised the cloud point of the spin fluid by about 500 psig (See FIG. 2, curve 27). A well fibrillated plexifilamentary product was obtained having a denier of 95, a modulus of 2.8 gpd, a tenacity of 1.5 gpd, and an elongation of 107%.

EXAMPLE 12

12 wt. % high density polyethylene having a melt index of 0.75 is dissolved in a mixture of methylene chloride and 1,1,2,2,3,3,4,5-octafluorocyclopentane in which the weight percent ratio of the primary solvent, methylene chloride, to the co-solvent, 1,1,2,2,3,3,4,5-octafluorocyclopentane, is 80/20. The 1,1,2,2,3,3,4,5-octafluorocyclopentane has an atmospheric boiling point of 79° C. The polyethylene and solvent are mixed at 200° C. and a pressure of 4000 psig for 30 minutes. The solution is spun at an accumulator pressure of 1200 psig, at a spin pressure of about 1100 psig, and at a temperature of 200° C. through the spin orifice. The presence of the co-solvent raises the cloud point of the spin fluid by more than 800 psig (See FIG. 5, curve 45). A well fibrillated plexifilamentary product is obtained.

EXAMPLE 13

12 wt. % high density polyethylene having a melt index of 0.75 is dissolved in a mixture of 1,2-dichloroethylene and 1,1,2,2,3,3,4,5-octafluorocyclopentane in which the weight percent ratio of the primary solvent, 1,2-dichloroethylene, to the co-solvent, 1,1,2,2,3,3,4,5-octafluorocyclopentane, is 75/25. The polyethylene and solvent are mixed at 200° C. and a pressure of 4000 psig for 30 minutes. The solution is spun at an accumulator pressure of 1400 psig, at a spin pressure of about 1200 psig, and at a temperature of 200° C. through the spin orifice. The presence of the co-solvent raises the cloud point of the spin fluid by more than 200 psi. A well fibrillated plexifilamentary product is obtained.

What is claimed is:

1. A spin fluid consisting essentially of (a) 8 to 18 wt. % synthetic fiber-forming polyolefin, (b) a primary solvent selected from the group consisting of methylene chloride and 1,2-dichloroethylene, and (c) a co-solvent selected from the group consisting of hydrofluoroethers, cyclic perfluorinated hydrocarbons, and cyclic partially fluorinated hydrocarbons, said co-solvent having (i) 3 to 7 carbon atoms (ii) and an atmospheric boiling point between 15 and 100° C., said co-solvent being present in the spin fluid in an amount sufficient to raise the cloud point pressure of the spin fluid by at least 50 pounds per square inch.

2. The spin fluid of claim 1 in which the co-solvent is selected from the group consisting of 1-trifluoromethyl-1-fluoro-2,2-difluorocyclobutane; 1,1,2,2,3,3-hexafluorocyclopentane; and 1,1,2,2,3,3,4,5-octafluorocyclopentane.

3. The spin fluid of claim 1 in which the co-solvent is selected from the group consisting of 1,1,1,2,3,3-fluoropropyl methyl ether; 1,1,1,2,2,3,3-fluoropropyl-1,2,2,2-fluoroethyl ether; 1,1,1,2,2,3,3,4,4-fluorobutyl methyl ether; and 1,1,1,2,2,3,3,4,4-fluorobutyl ethyl ether.

4. The spin fluid of claim 1 in which the co-solvent is selected from the group consisting of perfluorodimethylcyclobutane; perfluoro-N-methylmorpholine; and 1,2,3,3,4,4-fluoro-1,2-trifluoromethyl cyclobutane.

5. The spin fluid of claim 1 where the synthetic fiber-forming polyolefin is linear polyethylene.

6. The spin fluid of claim 1 where the synthetic fiber-forming polyolefin is polypropylene.

7. The spin fluid of claim 1 wherein the co-solvent is present in the spin fluid in an amount sufficient to raise the cloud point pressure of the spin fluid by at least 200 pounds per square inch.

* * * * *